US006381972B1

(12) United States Patent
Cotter

(10) Patent No.: US 6,381,972 B1
(45) Date of Patent: May 7, 2002

(54) MULTIPLE ZONE REFRIGERATION

(75) Inventor: Dennis Cotter, Glasgow (GB)

(73) Assignee: Hussmann Corporation, Bridgeton, MO (US)

( * ) Notice: Subject to any disclaimer, the term of this patent is extended or adjusted under 35 U.S.C. 154(b) by 0 days.

(21) Appl. No.: 09/868,670

(22) PCT Filed: Feb. 17, 2000

(86) PCT No.: PCT/US00/04169

§ 371 Date: Sep. 19, 2001

§ 102(e) Date: Jun. 19, 2001

(87) PCT Pub. No.: WO00/49345

PCT Pub. Date: Aug. 24, 2000

(30) Foreign Application Priority Data

Feb. 18, 1999 (GB) ..... 9903593

(51) Int. Cl.[7] ..... F25B 1/10; F25B 49/00
(52) U.S. Cl. ..... 62/126; 62/510
(58) Field of Search ..... 62/510, 259.1, 62/259.4, 246, 255, DIG. 16, 199, 200, 126

(56) References Cited

U.S. PATENT DOCUMENTS 3,180,109 A 4/1965 Kimmel
4,277,955 A * 7/1981 Parker ..... 62/510
4,995,243 A 2/1991 Ward
5,065,591 A * 11/1991 Shaw ..... 62/175
5,199,273 A * 4/1993 Silva et al. ..... 62/298
5,440,894 A * 8/1995 Schaeffer et al. ..... 62/203
5,743,102 A * 4/1998 Thomas et al. ..... 62/185
5,819,549 A * 10/1998 Sherwood ..... 62/246
5,953,929 A 9/1999 Bauman et al.
6,070,424 A 6/2000 Bauman et al.

* cited by examiner

*Primary Examiner*—Denise L. Esquivel
*Assistant Examiner*—Marc Norman
(74) *Attorney, Agent, or Firm*—Richard G. Heywood

(57) ABSTRACT

The invention is embodied in a refrigeration unit (R) adapted for use in combination with plural associated refrigerated fixtures (33*a*, 33*b*, 33*c*) in a commercial store, each fixture having a product zone and heat transfer cooling means (29) for the refrigeration thereof and which refrigeration unit comprises housing means (55, 57) with a mounting profile constructed to be accommodated substantially within the footprint area of one of said associated fixtures and arranged to support selective refrigeration components of a closed refrigeration circuit for supplying the refrigeration requirements of all associated fixtures, and which components include plural vapor phase compressor means (21) and a closely coupled coolant loop connected with the heat transfer cooling means.

40 Claims, 7 Drawing Sheets

MULTIPLE ZONE REFRIGERATION

RELATED APPLICATIONS

This application has subject matter in common with European patent application No. 94915916.4 filed Apr. 26, 1994 for Strategic Modular Refrigeration System (based upon U.S. application Ser. No. 08/057,617 granted as U.S. Pat. No. 5,440,894 on Aug. 15, 1995); and also in common with European patent application No. 97917750.8 filed Apr. 2, 1997 for Strategic Modular Secondary Refrigeration (based upon U.S. application Ser. No. 08/632,219 granted as U.S. Pat. No. 5,743,102 on Apr. 28, 1998).

FIELD OF THE INVENTION

This invention relates generally to the commercial refrigeration art, and particularly to a refrigeration unit which, in use, is used to refrigerate a plurality of cooling zones.

BACKGROUND OF THE INVENTION

A modular commercial refrigeration unit constructed and arranged for placement in strategic proximity to plural associated product cooling zones is known, and is disclosed in U.S. Pat. No. 5,440,894 commonly owned by HUSSMANN CORPORATION, the content of which is incorporated herein by reference. This prior art document discloses a supermarket or other food store refrigeration system including a refrigeration unit and a refrigeration network comprising a plurality of such units. The unit disclosed in U.S. Pat. No. 5,440,894 (marketed under the Trademark "PROTOCOL") is intended for use in cooling the zones of plural fixtures within a shopping arena (including the food merchandising and display area and the food storage and preparation area) of a food store.

The refrigeration unit comprises a condensing unit rack configured to accommodate the maximum refrigeration loads of the associated zones and being constructed to support the components of a closed refrigeration circuit including a plurality of multiplexed compressor means and associated high side and low side refrigerant delivery and suction means extending from the rack and being operatively connected to evaporator means constructed and arranged for cooling the associates zones, and which unit also has condenser means with a cooling source remote from the compressor rack but operatively constructed and arranged to provide a heat exchange relationship for providing optimum condensing and efficiency of said evaporator means in cooling the associated zones.

Another modular commercial refrigeration unit constructed and arranged for strategic placement near plural associated product cooling zones is known, and is disclosed in U.S. Pat. No. 5,743,102, commonly owned by HUSSMANN CORPORATION, the content of which is incorporated by reference. This prior art document discloses food store refrigeration including a refrigeration unit and cooling system. The unit disclosed in U.S. Pat. No. 5,743,102 (marketed under the mark "PROTOCHILL") is intended for cooling the product zones of plural display and storage merchandisers and fixtures. The unit comprises a condensing unit rack configured to accommodate the maximum refrigeration loads of associated fixture zones and being constructed to support components of a closed refrigeration circuit having multiplexed compressors and evaporator means with associated high side and low side refrigerant delivery and suction means operatively connected to the evaporator means, and which unit also includes condenser means operatively connected between the compressor and evaporator means as a component of the refrigeration circuit; and the unit also being constructed to support components of a coolant fluid system having heat transfer means associated with the evaporator means and pumping means for circulating a coolant through the heat transfer means in a closed coolant loop to cooling coils for the associated fixtures.

An important objective of the units disclosed in U.S. Pat. Nos. 5,440,894 and 5,743,102 was to seek to minimize the amount of refrigerant required in the food store refrigeration network.

A further object of the. units disclosed in U.S. Pat. Nos. 5,440,894 and 5,743,102 was to obviate the need for providing a dedicated remote plant/machine room thereby releasing valuable floor space within a supermarket or the like.

It has been found in practice that some merchants remain reluctant to position the prior art PROTOCOL and PROTOCHILL units anywhere on the sales floor of a store, thereby losing many of the refrigeration benefits which might be obtained.

It is an object of at least one aspect of the present invention to seek to address one or more of the perceived problems of the units disclosed in U.S. Pat. Nos. 5,440,894 and 5,743,102.

It is a further object of the present invention to provide a unit which, in use, effectively does not occupy any floor space.

It is yet a further object of at least one aspect of the present invention to seek to address the objects of the units as disclosed in U.S. Pat. Nos. 5,440,894 and 5,743,102.

Further objects and advantages of the unit of the present invention will become more apparent from the description provided hereafter.

Some of these various advantages provided by presently preferred embodiments of the present invention are:

- low noise and vibration levels;
- provision of two or more compressors so as to provide capacity control and back-up security;
- relatively short coupled pipework thereby seeking to reduce capital and running costs and installation time;
- relatively simple refrigeration circuitry;
- reduced refrigerant charge and cost, as well as smaller refrigerant gas loss in an event of leakage;
- flexibility for future retrofits;
- heat reclaim from fluid loops providing an advantageous energy use and improved efficiency of the refrigeration system/network;
- provision of a low profile for unobtrusive mounting on top of a cooling zone fixture.

SUMMARY OF THE INVENTION

According to a first aspect of the present invention there is provided a refrigeration unit adapted for cooling the multiple cooling zones such as a combination merchandiser or a plurality of fixtures, the unit including refrigeration circuit components comprising a close coupled compressor means, and wherein in use the unit is substantially contained within a footprint area similar to that of a cooling zone fixture.

Herein the term "footprint" of a cooling zone is understood to mean the floor space area occupied by the refrigerated fixture as viewed from above (or below).

The unit may be used in a food store, such as a supermarket or the like.

A "cooling zone" may comprise the product cooling space or refer to the footprint taken by a merchandising, storage or processing cabinet or fixture.

One or more of such merchandising cabinets may be provided in-line, back to back, or in closely adjacent proximity.

The unit is preferably provided over or on top of one product cooling zone (fixture).

The compressor means preferably comprises two or more compressors that are multiplexed by being connected in parallel in the refrigeration circuits, and preferably the compressors are of a horizontal scroll type. This provides the advantage of a "low-profile" unit which may be providentially or strategically placed on top of one product fixture while being constructed and arranged to refrigerate the plural cooling zones of at least two closely associated fixtures. Such horizontal scroll compressors are available from HITACHI under model number FL 200DL, FL 300DL, FL 400DL and FL 500DL. Alternatively, one or more of the compressors may be of a vertical scroll type.

According to a preferred embodiment of the present invention, a modular low-profile refrigeration unit is configured to accommodate the maximum aggregate refrigeration loads of at least two product cooling zones provided in a food store area, the unit comprising closed refrigeration circuit components including a plurality of multiplexed compressor means and associated refrigerant high side delivery means and low side suction means, the unit being constructed and arranged for placement, in use, in strategic proximity to the product cooling zones, and being operatively connected to evaporator means for the respective zones, and the refrigeration circuit also including condenser means.

The condenser means may include a condenser within the unit, which in use may be operatively associated with a remote cooling source so as to provide a heat exchange relationship with the condenser.

The remote cooling source may be a fluid cooling source, such as a cooling tower or a ground source water supply, or a dedicated normal temperature refrigeration system, a chiller system or recirculating water source or a combination of such alternate fluid cooling sources to assure the condenser means of a continuous supply of liquid coolant at a substantially constant temperature.

Alternatively, the condenser means may comprise a condenser remote from the unit and having a heat exchange cooling source, such as being air cooled.

Whether the condenser is located on board the refrigeration unit per se or remote therefrom, the condensing means may include heat reclaim which may be direct or as a heat pump.

According to a second aspect of the present invention there is provided a refrigeration system which includes at least one refrigeration unit according to the first aspect of the present invention.

The refrigeration unit of the system will cool the cooling zones of at least two fixtures, and the unit is substantially contained within the footprint size of one of the fixtures.

According to a preferred form of the second aspect of the invention, the system comprises a modular food store refrigeration system comprising: a plurality of cooling zones for at least two refrigerated fixtures having first closely adjacent locations in the store, separate (discrete) first stage evaporator means for cooling the refrigerated fixtures to maintain food product temperatures therein, the compressor means comprising multiplexed scroll type first stage compressors having a second location in the store in closely adjacent proximity to the first locations of the refrigerated fixtures, and first stage condenser means connected together with said first stage compressors and said first stage evaporator means to form a first stage closed loop refrigeration circuit; an exterior heat exchanger and a closed liquid heat transfer loop extending between the first stage refrigeration circuit and the exterior heat exchanger to transfer heat from the first stage condenser means to the exterior heat exchanger.

According to a third aspect of the present invention there is provided a refrigeration network including at least one refrigeration unit according to the first aspect of the present invention.

According to a preferred form of the third aspect of the present invention the network comprises:

a first modular refrigeration system unit according to the second aspect of the invention is placed in close strategic proximity to first cooling zones and includes first closed refrigeration circuit components including plural multiplexed compressor means with high side receiver means and associated high side and low side refrigerant delivery and suction means operatively connecting first evaporator means for cooling said first refrigerated zones, and said first refrigeration unit also including first condenser means operatively connected in the high side downstream of the compressor means;

at least one other modular refrigeration system unit placed in close strategic proximity to associated other cooling zones and comprising other closed refrigeration circuit components including other plural multiplexed compressor means with associated high side and low side refrigerant delivery and suction means operatively connecting other evaporator means for cooling the other refrigerated zones, and said other refrigeration unit also including other condenser means operatively connected in the high side downstream of the other compressor means;

and wherein the network may include the respective condensing means and a coolant circulating system having a plurality of heat exchanger circuits in heat exchange relationship with the respective first and other condensing means for the respective first and other refrigeration system units, said coolant circulating system having at least one continuous cooling source for the coolant in said circulating system.

According to a fourth aspect of the present invention there is provided a method of commercially refrigerating a plurality of cooling zones comprising: providing each cooling zone with at least one cooling coil; providing a refrigeration unit adapted for cooling the plurality of cooling zones; and locating the unit on top of the fixture for at least one of the cooling zones so as to be substantially contained within a footprint area of the selected one cooling zone.

According to a second embodiment of the invention, a modular commercial refrigeration unit configured to accommodate the aggregate refrigeration loads of at least two fixture cooling zones comprises a rack mounted closed circuit vapor phase refrigeration system having plural compressor means and an evaporative heat exchange means, and coolant fluid circulating means having a closed coolant loop in heat exchange relation with said evaporative heat exchanger and with coolant heat exchanger means for the cooling zones.

According to another aspect of the present invention, the refrigeration system and unit of the second embodiment is constructed and arranged for mounting within the footprint size of one cooling zone fixture. In this aspect, the unit may employ horizontally disposed scroll compressors and be disposed horizontally on top of a selected fixture, especially if the fixture is free standing in the shopping area of a food store.

Alternatively, the unit may employ vertical scroll compressors and be vertically disposed on top of a selected product fixture, especially if the fixture is positioned against a vertical store wall.

DESCRIPTION OF THE DRAWINGS

The embodiments of the present invention will now be described, by way of example only, and with reference to the accompanying drawings, in which.

DESCRIPTION OF THE PREFERRED EMBODIMENTS

For disclosure purposes, the term "high side" is used in a conventional refrigeration sense to mean the portion of a vapor phase system from the compressor discharge to the evaporator expansion valves, and the term "low side" means the portion of the system from the expansion valves to the compressor suction. Also, "low" temperature shall have reference to evaporator temperatures in the range of −35° F. to −5° F. or the associated frozen food and ice cream product temperatures in the range of −20° F. to 0° F.; and "standard" or "normal" (or "medium") temperature means evaporator temperatures in the range of about 15° F. to 40° F. or the associated non-frozen or fresh refrigerated food temperatures in the range of 25° F. to 50° F.

Figure 1:
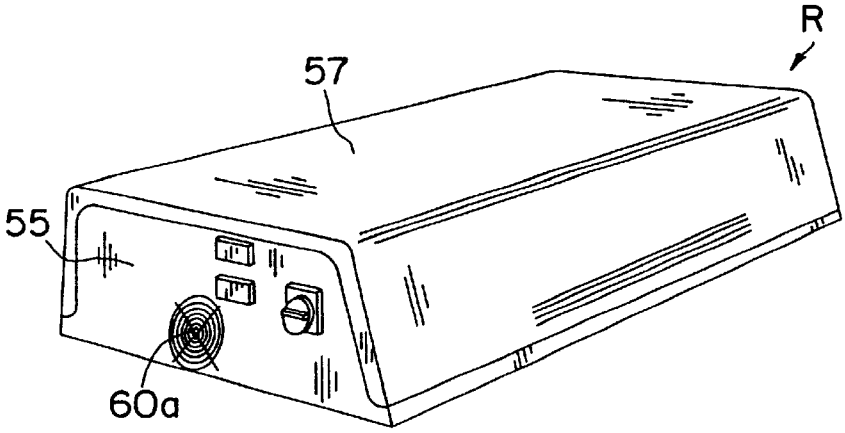
FIG. 1 is a front perspective view of a low-profile refrigeration unit according to a first embodiment of the present invention.
Figure 2:
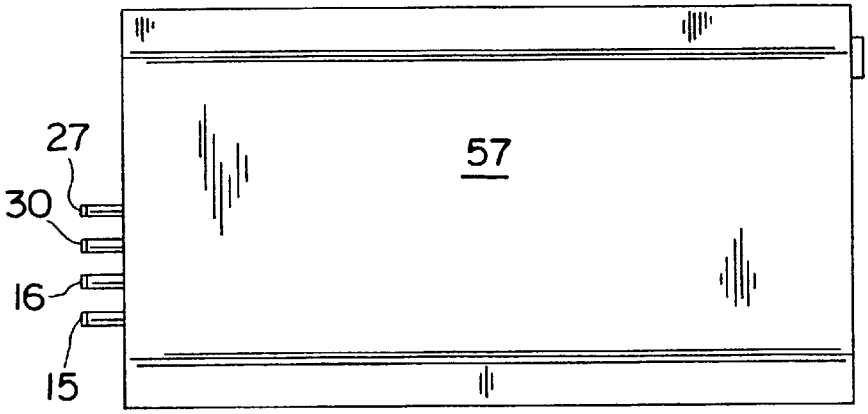
FIG. 2 is a plan view of the unit of FIG. 1.
Figure 3:
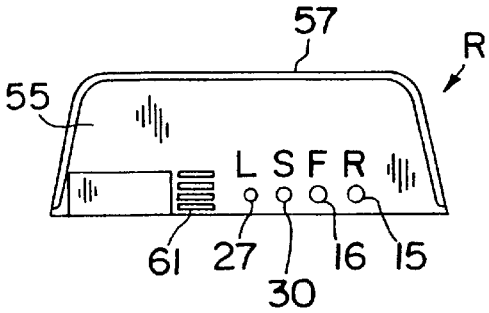
FIG. 3 is a view from the other end of the unit of FIG. 1.
Figure 9:
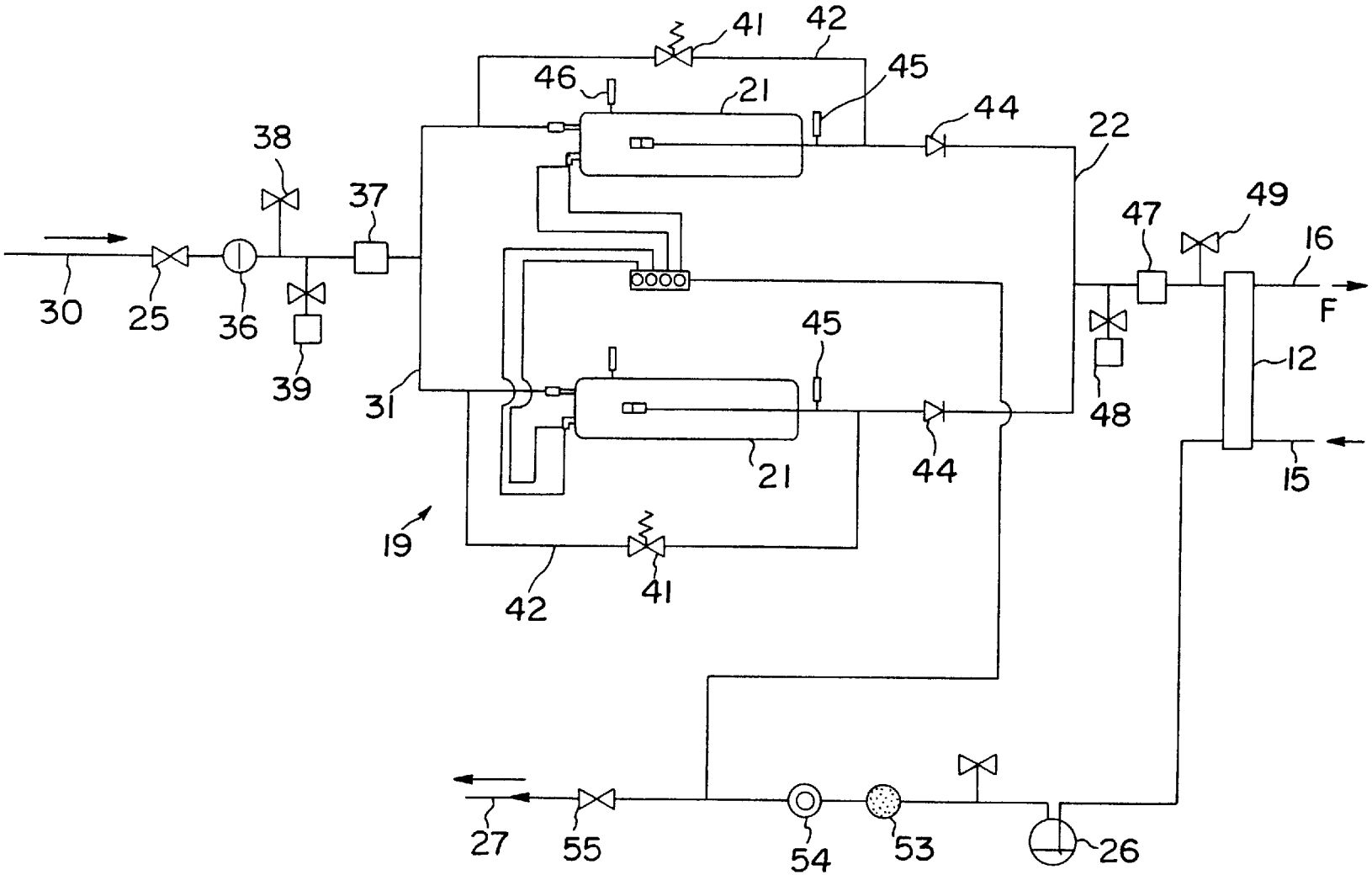
FIG. 9 is an alternate schematic view of the refrigeration system of FIG. 8.

Referring to FIGS. 1 and 9, there is illustrated a refrigeration unit, generally designated R, according to a first embodiment of the present invention. The refrigeration unit R is adapted for cooling a plurality of product cooling zones, the unit R including refrigerated circuit components comprising multiple compressor means 21, and wherein in use the unit R is sized to be substantially contained within a footprint size of one of the cooling zones. In this description the term "footprint" of a cooling zone is defined as the floor space occupied by a selected cooling fixture as viewed from above (or below) In this embodiment the unit R is adapted for use in a food store such as a supermarket and, accordingly, each cooling zone generally comprises the product area of a single merchandising cabinet or fixture 33. Of course, the location of the refrigeration units R may be outside the actual customer shopping arena as when the cooling zones are storage fixtures or food preparation rooms. In each case the modular refrigeration unit R is sized to efficiently maintain its associated multiplicity of discrete cooled zones at optimum refrigeration temperatures, and it will be understood that these zones comprise one or more of the supermarket coolers, freezers, preparation rooms or display merchandisers, the latter usually being an area department or combination lineup of merchandising fixtures operating at substantially the same temperature.

Figure 4:
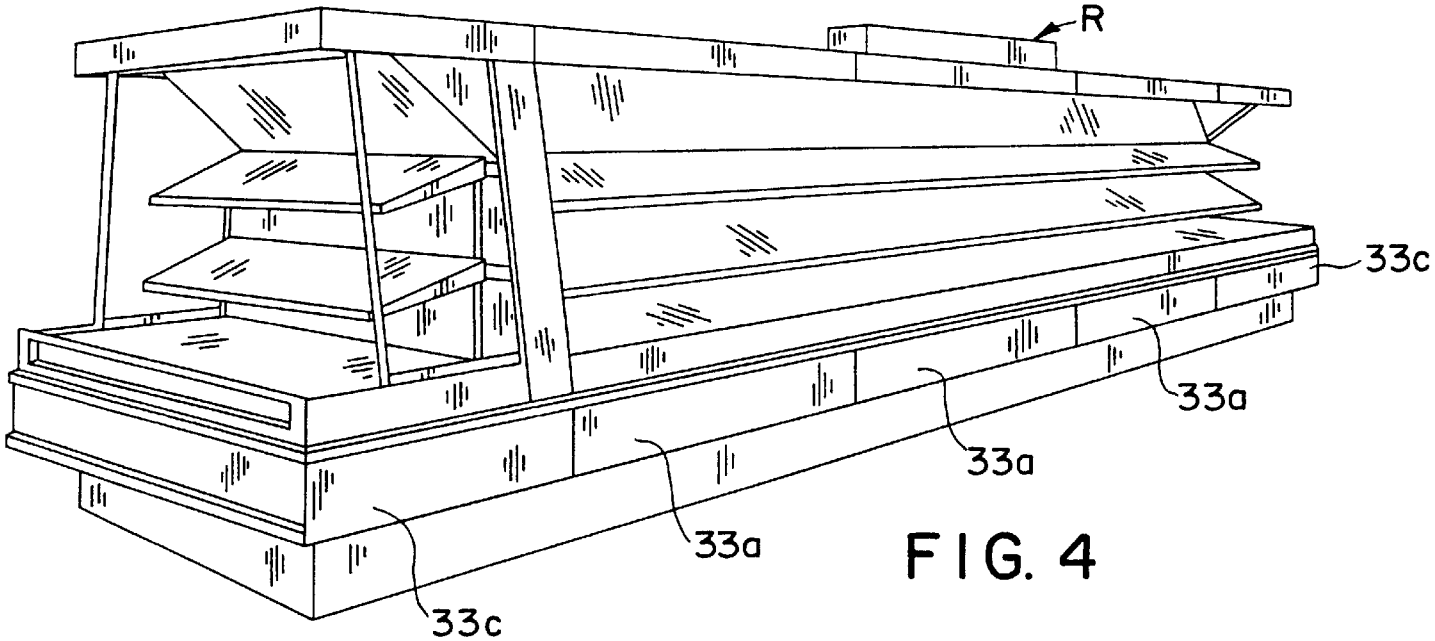
FIG. 4 is a front perspective view of a multiple zoned or combination merchandiser including the unit of FIG. 1.
Figure 5:
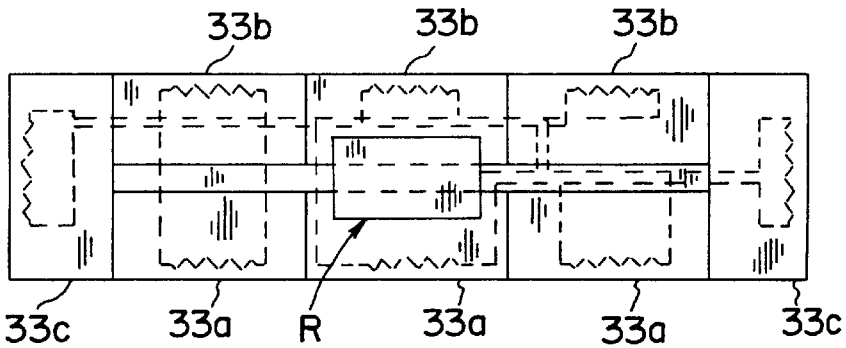
FIG. 5 is a plan view of the refrigeration system of FIG. 4.

As can be seen from FIGS. 4 and 5, one or more of such merchandising cabinets or fixtures 33 may be combined in-line and/or back-to-back. In this embodiment eight such merchandising fixtures 33 are provided in which three (3) in-line cabinets 33*a* are arranged back-to-back with three (3) other in-line cabinets 33*b,* and these are capped by end cabinets 33*c*. In another arrangement the plural fixtures could be two single cabinets located on opposite sides of a store wall, or another arrangement of closely adjacent fixtures 33. Further, a single unit R is shown on top and bridging across two of the merchandising cabinets 33 although the preferred unit is sized to be accommodated within the footprint of a single discrete fixture.

Figure 8:
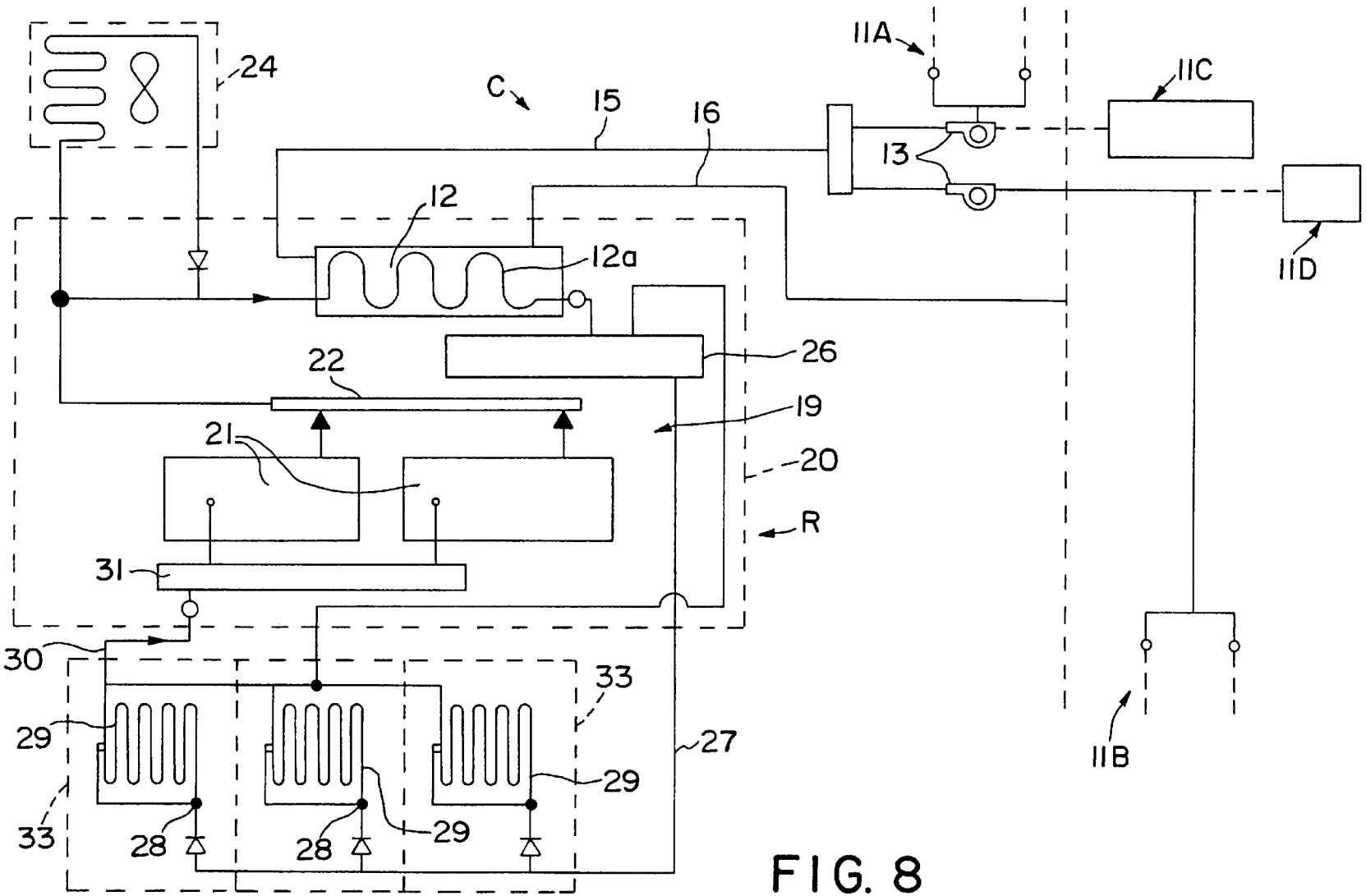
FIG. 8 is a diagrammatic view of one embodiment of refrigeration circuitry for a system embodying the invention.

Referring to FIGS. 1–3 and 6–9, each of the modular units R includes a condensing unit rack or base 20 constructed and arranged to mount and support the operative components of a closed refrigeration circuit 19 dedicated to the refrigeration load requirements of its associated discrete product zones 33. A typical condensing unit rack 20 of the present invention preferably has two small multiplexed horizontal scroll compressors 21 or like variable capacity compressing means that is connected by a discharge header 22 to the system condenser 12, also preferably located on the rack 20 in the preferred embodiment. In FIG. 8 it will also be seen that a heat reclaim coil 24 may be selectively connected into the high side upstream of the condenser 12. An oil separator (not shown) may be incorporated into the system 19 downstream of the discharge manifold 22. In the preferred embodiment, the closed (vapor compression) refrigeration system 19 may be critically charged with refrigerant and therefore requires no liquid receiver to receive the condensate outflow from the condenser 12. However, for illustration a liquid receiver 26 is shown and more than a critical amount of refrigerant may be employed without departing from the scope of the present invention. The high side of the circuit 19 is connected by liquid line 27 to an evaporative expansion valve 28 for the evaporative cooling means 29 associated with the discrete product cooling zones (33) to be cooled. On the low side, the refrigerant expands and vaporizes in the merchandiser evaporators 29 removing heat from the product zone 33 to maintain the preselected desired cooling. The outlets of the evaporators 29 connect by suction lines 30 to a common suction header or manifold 31 and thence to the suction side of the compressors 21 to complete the refrigeration circuit.

In this embodiment the compressor means comprises the two compressors 21, which are multiplexed with one another—that is connected in parallel within the refrigeration circuit. Preferably, the compressors 21 are of the horizontal scroll type as available from HITACHI under model numbers FL 200DL, FL 300DL, FL 400DL and FL 500DL. Provision of the horizontal scroll compressors 21 within the unit R allows for the provision of a unit with a "low-profile"

which may be placed discreetly on top of a selected merchandising cabinet 33 so as to be at least partially obscured from view by persons moving around the floor of the supermarket. It will be understood that although the unit R is sized to fit within the profile of a single fixture 33, in practice it may be placed to overlap or bridge across two or more fixtures.

Referring especially to FIG. 9, the refrigeration circuit 19 of the unit R comprises a low side or suction line 30 (S) and a high side or liquid line 27 (L). The suction line 30 is connected to one end of a normally open isolation service valve 25 which can be shut off for installation and servicing of the refrigeration unit R. The other side of the shut-off valve 25 is connected through a suction strainer 36, which is connected through safety valve 37 to the suction header 27. A gauge 38 tees off of line 30 and a further T junction connects to a control transducer 39 which senses the pressure of the refrigerant in the suction line 30. If the pressure of the refrigerant from the suction line 30 falls below a predetermined level, the operation of the unit R is controlled to ensure that the compressors 21 are not damaged.

The compressors 21 are connected in parallel and are provided with solenoid valves 41 in by-pass lines 42 for control at start up of the compressors 21 to balance pressures. The high side of each compressor 21 is provided with a one-way check valve 44 to isolate the high side refrigeration circuit of each compressor at start up as pressures are balanced. Also teed to the output of each of the compressors 21 are discharge stats 45, and an injection stat 46 is connected to each compressor. A safety switch 47 is connected to the high side from the discharge manifold, and discharge pressure read-out 48 and gauge connector 49 are provided.

It will be understood that the refrigeration system units R will generally include still other system components, such as defrost system means, system performance sensing and operating control panel and microprocessor apparatus, alarm systems and the like. As shown in FIG. 9, the unit R includes a connection to the liquid refrigerant receiver 26 followed by a liquid drier/desicator 53, liquid sight glass 54 and one-way valve 55.

Although the refrigeration system condenser 12 is preferably located on the unit rack 20, it may be roof mounted outside the food store for air cooled operation in a typical manner. When located on the rack 20 it is essential that the sensible heat be rejected outside the shopping arena, and the condenser 12 thus may be cooled in numerous ways. A coolant fluid circulating system C can be provided to circulate a cooling fluid or coolant from a remote source (11) to the respective unit condenser/heat exchangers 12. Thus, the coolant system C derives a cooling liquid, such as water or glycol, from one or more remote sources 11, 11A and 11B and circulates it to the condenser 12 of each modular unit R. The coolant source 11 may be a single fluid cooling apparatus, such as a closed or open loop roof top cooling tower 11A or a ground source water supply 11B, or a chiller system or recirculating water source 11 or a combination of such alternate fluid cooling sources to assure a continuous supply of coolant at a substantially constant temperature. In this embodiment the condenser 12 which is a plate type condenser, has a heat exchanger with a cooling loop 12*a* from the remote cooling source.

Thus, the invention further comprises the use of a secondary coolant system C for the direct distributed load cooling of the heat exchange coils 29 of the merchandisers 33 dedicated to the respective units R. As can be seen from FIGS. 1, 3, 8 and 9, a coolant fluid input line 15 (F) and a fluid output line 16 (R) of the condenser 12 are connected to a remote cooling source (11) so as to provide a heat exchange relationship with the condenser 12.

Figure 10:
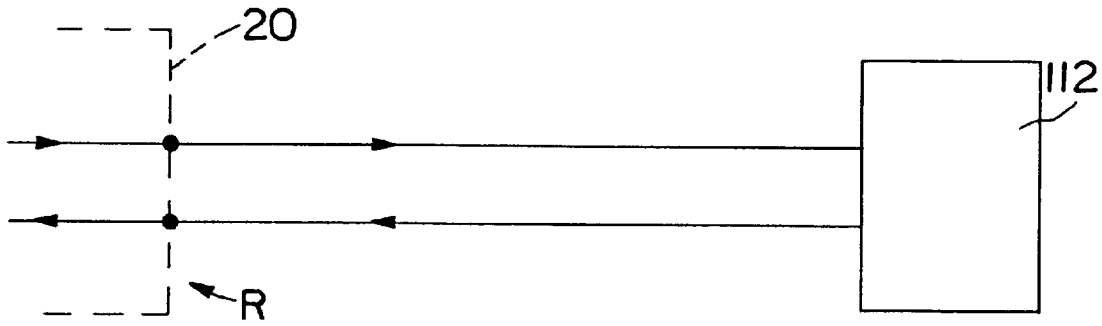
FIG. 10 is a partial schematic view showing a modification of the refrigeration system of FIGS. 8 and 9.

Referring to FIG. 10, as stated above an alternate embodiment the unit R may not provide condensing means on board (on the rack 20), but condenser means 112 is provided at a location remote from the unit R. The remote condenser 112 may be roof mounted on the store and comprise an air cooled source.

Referring again to FIGS. 1–3, 6 and 7, the unit R includes a condensing unit rack 20 comprising a base or chassis 56 with fixed upstanding end walls 55 and a removable lid or cover 57 which preferably is sound proofed. The compressors 21 and other refrigeration components included in the unit R are mounted to the base 56, the compressors 21 being mounted via a sub-frame. The relatively compact size of the unit R may be discerned by the following typical dimensions: length 1290 mm; depth 750 mm; height 275 mm.

Figure 6:
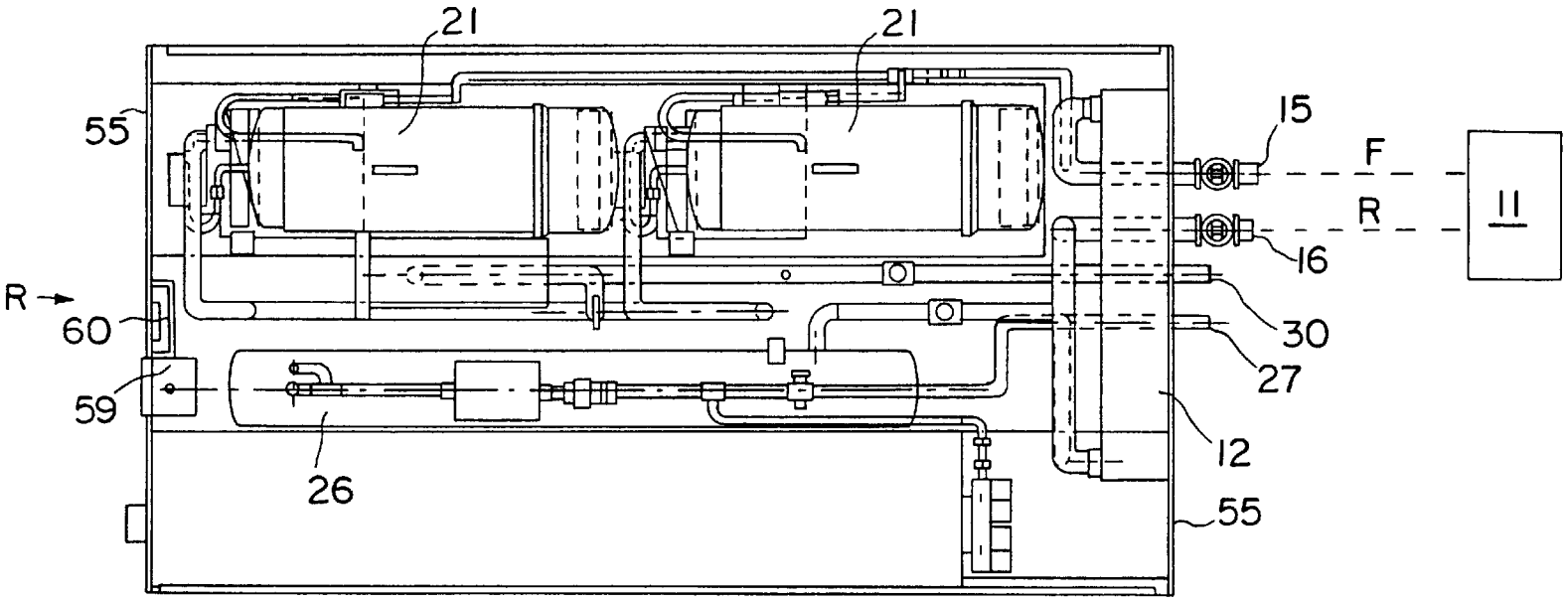
FIG. 6 is a plan view of the unit of FIG. 1 with a cover of the unit removed.
Figure 7:
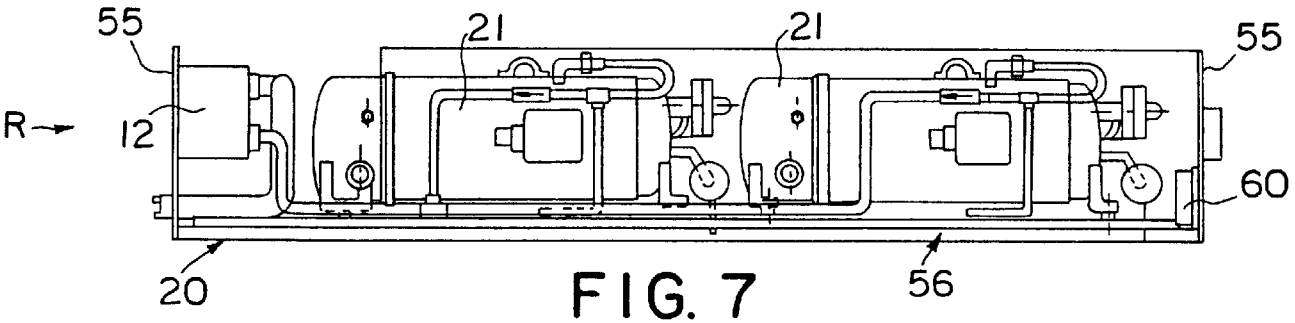
FIG. 7 is a side elevational view of the unit of FIG. 1 with the cover removed.

Referring to FIG. 6, the electrical circuitry for the unit R includes a main unit (pack) controller 59, a power supply circuit for each compressor 21, a circulating fan 60 with a fan guard 60 a being placed thereover. As can further be seen from FIG. 3, at least one vent 61 is provided at the one end wall 55 of the unit R. The combination of the fan 60 and vents 61 allow a through flow of air within the unit R.

In use, the unit R may be incorporated with the refrigeration system 19 for the merchandising cabinets 33, and which refrigeration unit components comprise, at least the multiple compressor means 21, and wherein in use the unit R is substantially sized for containment within the footprint of one of the merchandising cabinets 33.

The refrigeration unit R may have an evaporating temperature of around −8° C., a suction return temperature of around 5° C., a condensing temperature of around 35° C., and a liquid temperature of around 32° C., in a preferred embodiment. Further it will be appreciated that a plurality of combined compressors 21 may be provided so as to provide the desired refrigeration capacity. For example, as detailed below.

| Compressor models | HP |
|---|---|
| 2 x FL 200DL | 2/4 |
| 1 x FL 200DL plus 1 x FL 300DL | 2/3/5 |
| 2 x FL 300DL | 3/6 |
| 1 x FL 300DL plus 1 x FL 400DL | 3/4/7 |
| 2 x FL 400DL | 4/8 |
| 1 x FL 400DL plus 1 x FL 500DL | 4/5/9 |
| 2 x FL 500DL | 5/10 |

From the foregoing it will be appreciated that a refrigeration unit R according to a preferred embodiment of the present invention provides a compact, low profile, multi-compressor package which can be mounted on top of a single display fixture or other refrigerated case 33 and takes up no floor space within the store. The unit R disclosed preferably has two parallel connected (multiplexed) scroll compressors 21 with a selected range from 4HP to 10HP or more.

In a supermarket, a plurality of such refrigeration systems 19 may be provided so as to provide a refrigeration network for the entire store. The units R may be constructed and arranged to provide the lowland medium temperature needs of the store. Further, it will be appreciated that a plurality of compressors 21 may be provided so as to provide the requisite refrigerant capacity, whereby different sizes of compressors may be utilized on the condensing rack 20 of different units R. It will be known in the trade that a "condensing rack" necessarily includes the compressors as the prime mover of the condensing function, but that the condenser per se may be provided at different locations other than the rack. From the foregoing it will be appreciated that a unit R according to a preferred embodiment of the present invention provides a compact, low profile, multi-compressor package which can be mounted on top of a selected discrete cabinet or fixture 33 and, since it takes up no floor space within a shopping arena, it truly meets the requirements for optimum placement. The unit R according to the preferred embodiment disclosed hereinbefore has two parallel connected horizontal scroll compressors 21 with a range from about 2HP to 5HP each.

The preferred embodiment of the unit R disclosed hereinbefore is a fluid cooled unit, and employs a plate heat condenser 12. The unit R may also incorporate a small liquid receiver 26, and an electrical control panel and complete internal refrigeration pipework and electrical wiring. With the evaporator (29) connections arranged from the top of the merchandising cabinets 33, external pipework is of an optimum length and relatively easy to install.

Figure 11:
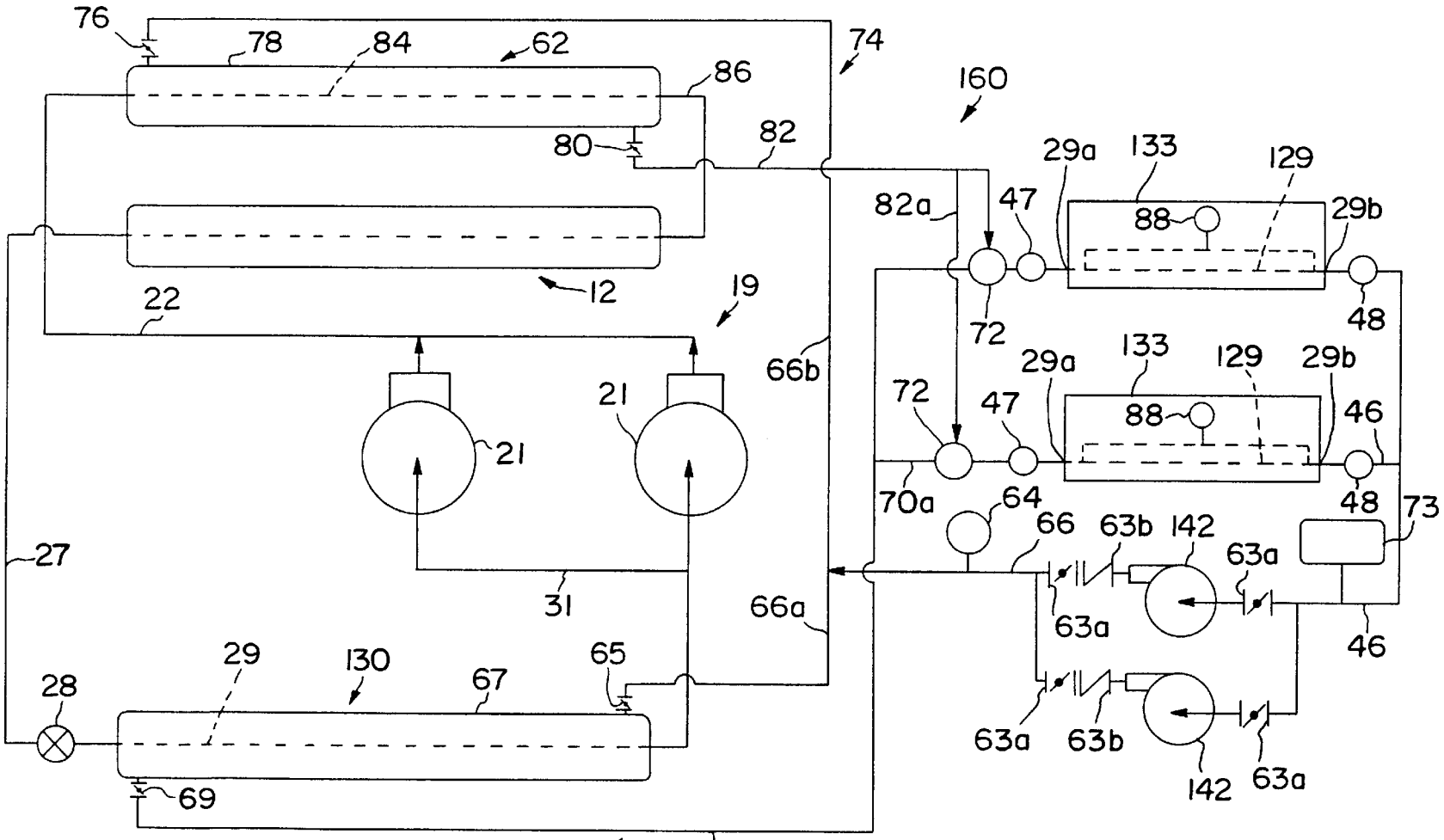
FIG. 11 is a diagrammatic view of another embodiment of a refrigeration circuit.

Another embodiment of the commercial refrigeration unit R of the present invention is shown in FIG. 11. This unit is similar in many respects to that of FIGS. 1–10 in that a condensing unit rack 20 houses a closed refrigeration system 19 with multiplexed compressors 21 and the closed (vapor compression) refrigeration system 19 may be critically charged with refrigerant and therefore requires no liquid receiver to receive the condensate outflow from the condenser 12. The high side of the circuit 19 is connected by liquid line 27 to an evaporative expansion valve 28 for evaporator means 29 forming a part of the closed refrigeration circuit 19 and being constructed and arranged with a coolant chiller unit 130. On the low side, the refrigerant in the evaporator 29 removes heat from the coolant fluid and the evaporator outlet connects by suction line 31 to the suction side of the compressors 21 to complete the closed refrigeration circuit. Although the refrigeration system condenser 12 is preferably located on the unit rack 20, it may be roof mounted outside the food store for air cooled operation in a typical manner.

This embodiment further comprises the use of a secondary coolant system 160 for the direct distributed load cooling of the heat exchange coils 129 of the merchandisers 133. Thus, in this embodiment the rack mounted refrigeration system evaporator 29 is part of the heat exchanger chiller unit 130 for the coolant system. Preferably the pumping means 142 for the secondary cooling system 160 is also rack mounted, and is connected to circulate the glycol coolant fluid or the like through the chiller heat exchanger 130 and thence outflow through conduit 70 to its distributed load at each associated merchandiser display case heat transfer coil 29. The cold coolant fluid removes heat from the coil 129 (typically of conventional tube and fin construction) and the fluid is thence circulated back to the pump 142 through return conduits 46. The construction and operation of the modular secondary system of this embodiment will be more fully understood with reference to U.S. Pat. No. 5,743,102 (incorporated by reference herein).

Since a principal feature of the invention is to place the modular refrigeration unit R strategically in close proximity to the dedicated cooling zone of an associated merchandiser 33 in order to eliminate the traditional machine back room, long piping connections and large refrigerant requirements formerly required, it will be seen that the mounting of the unit R on top of the merchandiser 33 provides an optimum solution to meet all of the objectives of the invention.

It will be appreciated that the embodiments of the invention hereinbefore described are given by way of example only, and are not meant to limit the scope of he invention in any way. Particularly various modifications may be made to the disclosed embodiments without departing from the scope of the invention.

What is claimed is:

1. A refrigeration unit adapted for use in combination with plural associated refrigerated fixtures in a commercial store, each of said fixtures having an insulated top wall enclosure and an interior product zone and heat transfer cooling means for the refrigeration thereof; said refrigeration unit comprising a housing with a mounting profile constructed so as to be accommodated within the top wall footprint area of one of said associated fixtures and being arranged to support selective refrigeration components of a closed refrigeration circuit for supplying the refrigeration requirements of all associated fixtures, which said components include plural vapor phase compressor means and a closely coupled cooling loop for connection with the heat transfer cooling means of all associated fixtures.

2. The refrigeration unit of claim 1 in which two of said plural compressors are scroll compressors.

3. The refrigeration unit of claim 1, in which two of said plural compressors are scroll compressors having different capacities.

4. The refrigeration unit of claim 1, in which said unit has a horizontal mounting profile accommodating side by side horizontally disposed compressors.

5. The refrigeration unit of claim 4, in which the one said associated fixture Us free standing within the commercial store, and the refrigeration unit is accommodated over the top of said one associated fixture with its horizontal profile abutting the top wall thereof.

6. The refrigeration unit of claim 1, in which said refrigeration unit has a vertical mounting profile accommodating vertically disposed compressors.

7. The refrigeration unit of claim 6, in which the one said associated fixture is positioned against a vertical wall structure of the commercial store, and the refrigeration unit is accommodated over the top of said one associated fixture with its vertical profile abutting such wall structure.

8. The refrigeration unit of claim 1, in which said housing includes a mounting base and end walls connected thereto for accommodating the selected refrigeration components and for mounting the piping connection of the close coupled cooling loop.

9. The refrigeration unit of claim 8, in which said housing includes cover means for covering the entire mounting base between the end walls to encase the refrigeration components therein.

10. The refrigeration unit of claim 9 in which the housing is constructed and arranged to provide a sound absorbing barrier.

11. The refrigeration unit of claim 8, in which said housing is constructed and arranged to internally accommodate piping connections extending externally thereof through at least one end wall to be piped to the heat exchange cooling means for all associated fixtures.

12. The refrigeration unit of claim 1, including control panel instrumentation for monitoring the operation of the refrigeration unit.

13. The refrigeration unit of claim 1, in which said housing comprises a mounting base forming a condensing unit rack for supporting said plural compressor, and said compressors are part of a closed vapor phase refrigeration system that includes liquid and suction line connections.

14. The refrigeration unit of claim 13, which includes a condenser as a part of the closed vapor phase refrigeration system.

15. The refrigeration unit of claim 14, in which said condenser is part of a first heat exchanger supported on a mounting base and having condenser cooling means.

16. The refrigeration unit of claim 15, in which the mounting base of said condenser is mounted on the condensing unit rack.

17. The refrigeration unit of claim 15, in which said condenser cooling means comprises an external liquid cooling source selected from a class consisting of a fluid cooling tower, a coolant chiller system, a cold ground water supply, a dedicated refrigeration system or an air cooled heat exchanger.

18. The refrigeration unit of claim 14, in which the heat transfer cooling means of the associated fixtures comprise evaporator coils as part of the closed vapor phase refrigeration circuit and being connected between said condenser on the high side and said plural compressors on the low side.

19. The refrigeration unit of claim 14, which includes an evaporative cooling heat exchanger having an evaporator coil as part of the closed vapor phase refrigeration system.

20. The refrigeration unit of claim 19, in which said heat transfer cooling means comprises a liquid cooled heat exchanger as part of a glycol-type liquid coolant system having a cooling phase in which the cooling loop is connected to the evaporative cooling heat exchanger.

21. The refrigeration unit of claim 13, in which said condenser is remotely located from the housing and condensing unit rack thereof and is either water cooled or air cooled.

22. The refrigeration unit of claim 1 in combination with said plural associated refrigeration fixtures, said plural compressors being connected through cooling loops with the heat transfer cooling loop of each fixture.

23. In combination with at least two refrigerated fixtures in a commercial store, each of which fixtures has an insulated cabinet with an imperforate exterior top wall surface and an interior product zone and including heat transfer cooling means for the refrigeration of said product zone; a refrigeration unit comprising a unitary housing with a base mounting profile constructed so as to be accommodated within the top wall area of one of said refrigerated fixtures and being arranged to support selective refrigeration components of a refrigerating circuit including plural vapor phase compressors, and a closely coupled cooling loop connected to supply the refrigeration requirements of the heat transfer cooling means of all refrigerated fixtures.

24. The combination of claim 23, in which each of said refrigerated fixtures has separate air circulating means for circulating air over the heat transfer cooling means and through the product zone thereof.

25. The combination of claim 23 in which said plural compressors are scroll compressors.

26. The combination of claim 23, in which two of said plural compressors are scroll compressors having different capacities.

27. The combination of claim 23, in which said refrigeration unit has a horizontal base mounting profile and accommodates the unitary housing of horizontally disposed compressors.

28. The combination of claim 27, in which the one said refrigerated fixture is free standing adjacent to the other of said refrigerated fixtures, and the refrigeration unit is accommodated over the top of said one refrigerated fixture with its horizontal base profile abutting the top wall thereof.

29. The combination of claim 23, in which said refrigeration unit has a vertical mounting profile and accommodates vertically disposed compressors.

30. The refrigeration unit of claim 23, in which said unitary housing includes a mounting base for supporting the selected refrigeration components and end walls for mounting the piping connections of the closely coupled cooling loop.

31. The refrigeration unit of claim 30, in which said housing means includes cover means for covering the entire mounting base between the end walls to thereby encase the refrigeration components therein.

32. The combination of claim 30, in which said unitary housing is constructed and arranged to internally accommodate piping connections extending externally thereof through at least one end wall to connect to the heat transfer cooling means.

33. The refrigeration unit of claim 23 in which the unitary housing is constructed and arranged to provide a sound absorbing barrier.

34. The combination of claim 23, which includes a condenser means as a part of the vapor phase refrigeration circuit of said refrigeration unit.

35. The combination of claim 34, in which said condenser is part of a first heat exchanger supported on the unitary housing and includes condenser cooling means.

36. The combination of claim 35, in which said condenser cooling means comprises an external cooling source selected from a class consisting of a fluid cooling tower, a coolant chiller system, a cold ground water supply, a dedicated refrigeration system or an air cooled heat exchanger.

37. The combination of claim 35, in which said condenser is remotely located from the unitary housing and is either water cooled or air cooled.

38. The combination of claim 34, in which the heat transfer cooling means of the refrigerated fixtures comprise evaporator coils as part of the closed vapor phase refrigeration circuit and being connected between said condenser on the high side and said plural compressors on the low side.

39. The combination of claim 34, which includes an evaporative cooling heat exchanger having an evaporator coil as part of the closed vapor phase refrigeration circuit.

40. The combination of claim 39, in which said heat transfer cooling means of said refrigerated fixtures comprises a liquid cooled heat exchanger as part of a glycol-type liquid coolant system having a cooling phase in which the cooling loop is connected in heat exchange relation to the evaporative coil.

* * * * *